US010300725B2

(12) United States Patent
Bishop

(10) Patent No.: US 10,300,725 B2
(45) Date of Patent: May 28, 2019

(54) TALLY STAMP DEVICES, SYSTEMS, AND METHODS

(71) Applicant: Charles Bishop, Portland, OR (US)

(72) Inventor: Charles Bishop, Portland, OR (US)

(73) Assignee: Charles Bishop, Los Gatos, CA (US)

( * ) Notice: Subject to any disclaimer, the term of this patent is extended or adjusted under 35 U.S.C. 154(b) by 0 days.

(21) Appl. No.: 15/642,060

(22) Filed: Jul. 5, 2017

(65) Prior Publication Data

US 2018/0009250 A1 Jan. 11, 2018

Related U.S. Application Data

(60) Provisional application No. 62/358,324, filed on Jul. 5, 2016.

(51) Int. Cl.

| | |
|---|---|
| ***B41K 1/36*** | (2006.01) |
| ***G06M 1/08*** | (2006.01) |
| ***B41K 1/42*** | (2006.01) |
| ***B41K 1/52*** | (2006.01) |
| ***B41K 1/56*** | (2006.01) |

(52) U.S. Cl.

CPC ..... *B41K 1/366* (2013.01); *B41K 1/42* (2013.01); *B41K 1/52* (2013.01); *B41K 1/56* (2013.01); *G06M 1/083* (2013.01)

(58) Field of Classification Search

CPC . B41K 1/00; B41K 1/003; B41K 1/36; B41K 1/363; B41K 1/366; B41K 1/38; B41K 1/40; B41K 1/50; B41K 1/52; B41K 3/32; B41K 3/62; B41K 3/625; B41K 5/04; B41K 5/08

See application file for complete search history.

(56) References Cited

U.S. PATENT DOCUMENTS

| | | | | |
|---|---|---|---|---|
| 4,532,642 | A | 7/1985 | Morris et al. | |
| 4,993,050 | A * | 2/1991 | Carpenteri | G06M 1/083 235/64 |
| 5,442,380 | A | 8/1995 | McCormick | |
| 5,506,876 | A | 4/1996 | Homer | |
| 5,646,975 | A | 7/1997 | Homer | |
| 5,995,123 | A * | 11/1999 | McCormick | B43K 8/024 346/14 MR |
| 6,253,673 | B1 * | 7/2001 | Chen | B41K 1/003 101/368 |
| 6,834,584 | B1 | 12/2004 | MacNeil | |
| 7,172,358 | B1 * | 2/2007 | Rudelius | B43K 7/12 346/139 R |
| 7,954,429 | B1 * | 6/2011 | Abukhdair | B41K 1/366 101/103 |
| 8,695,500 | B2 * | 4/2014 | Faber | B41K 1/003 101/104 |
| 9,211,754 | B2 * | 12/2015 | Zehetner | B41K 1/006 |
| 2003/0047095 | A1 * | 3/2003 | Cho | B41K 1/04 101/327 |
| 2016/0311244 | A1 | 10/2016 | Pullaro, Jr. et al. | |

* cited by examiner

*Primary Examiner* — Thien M Le
*Assistant Examiner* — April A Taylor
(74) *Attorney, Agent, or Firm* — Fish & Richardson P.C.

(57) ABSTRACT

Some embodiments of a tally stamp device described herein provide a stamp and a counter system. The tally stamp may include an elongate body housing the stamp and counter system.

16 Claims, 5 Drawing Sheets

TALLY STAMP DEVICES, SYSTEMS, AND METHODS

CROSS-REFERENCE TO RELATED APPLICATIONS

This application claims priority to U.S. Provisional Application Ser. No. 62/358,324, filed on Jul. 5, 2016, the entire contents of which are hereby incorporated by reference.

TECHNICAL FIELD

This document describes devices, systems and methods for counting and stamping devices, and in some embodiments, tally stamp devices having a digital tally counter and an ink stamper in a housing.

BACKGROUND

Various counting devices are well known. Counting devices have been proposed that allow a user to manually increment a count total. For example, various counting devices include portable, hand-held devices that allow a user to count the number of occupants entering a building or facility, cars passing along a roadway, or other occurrences or items of interest. Various marking devices are also well known, and may allow a user to mark people or objects that are the subject of counting.

SUMMARY

In general, this document describes devices, systems and methods for counting and marking a series of people or objects. Exemplary tally stamp devices may include a marking device and one or more inputs that increment a counter. Such devices may improve counting and marking accuracy and convenience by allowing a user to perform multiple functions of applying a mark and incrementing a counter in a single action.

For example, some embodiments described herein provide an ergonomic housing including a self-inking stamp and a digital tally counter. The self-inking stamp may pivot and apply an ink marking to a target upon actuating of the device (e.g. by pressing the device onto the desired target). Movement of the self-inking stamp may actuate the digital tally counter to increment the counter. In this way, the number of ink markings applied by the self-inking stamp can be automatically tracked with each actuation of the self-inking stamp. In various exemplary embodiments, the self-inking stamp and digital tally counter are arranged within a common housing that may be comfortably held in a single hand for an extended period of time. The device may include a display positioned to be visible to an operator while the device is held in a single hand, for example while the self-inking stamp is applied.

Particular embodiments described herein may include a self-inking stamp at a bottom of the housing of the tally stamp device. A display may be positioned at a top of the housing of the tally stamp device (e.g. on a side of the housing opposite from the self-inking stamp). The housing may further include a plurality of sides between the top and bottom, including a side having a plurality of finger grips. An independent count actuator may be positioned proximate the finger grips configured to increment the tally count independent of actuation of the self-inking stamp.

Some embodiments of the devices, systems and methods described herein may provide one or more of the following advantages. First, tally stamp devices described herein may provide convenient, accurate, and highly-portable instruments for counting and marking a plurality of subjects. A common housing having an elongate body provides an easy to hold device that may be actuated and viewed with a single hand, freeing a second hand for other uses. Second, some exemplary tally stamp devices described herein allow several actuation modes with a single hand. An operator may apply a marking and increment the tally count, or may independently apply a marking or may independently increment the tally count with a single hand and without undue manipulation that could be distracting or complicated. Third, tally stamp devices described herein are highly portable and may be easily held in a single hand, carried on a key-chain, or in a small bag or pouch, for example. Fourth, some exemplary tally stamps described herein can incorporate a light source that directs light towards a stamp target, a wireless transmitter that communicates count information, and/or one or more other components accommodated at least partially within the housing of the device.

In some embodiments, an exemplary tally stamp includes an elongate body having a top and bottom, and front, rear, left and right sides extending between the top and bottom, the elongate body defining a longitudinal axis extending between the top and bottom, an ink stamp positioned proximate the bottom of the elongate housing movable in a direction parallel to the longitudinal axis between a marking position in which the ink stamp is exposed and a storage position in which the ink stamp is retracted, and a counter system including a first actuator and a display, the display positioned on the top of the elongate housing and having a top perimeter and a bottom perimeter, the counter system incrementing a stored count by one when the pivoting ink stamp is moved to the marking position. The display may be positioned on the top of the elongate body between the front side and rear side and the actuator may be positioned on the top of the elongate body between the display and the read side.

Implementations can include any, all, or none of the following features. The elongate body may have a length (l) between the top and bottom sides and a width (w) between the left and right sides length (l)>width (w). The elongate body may include a perimeter (p) measured around the front, rear, left and right sides in a direction perpendicular to longitudinal axis (A), and perimeter (p) is between 0.75*(l) and 1.5*(l). The front side may include a plurality of ridges. The first actuator may be actuatable in a direction parallel to longitudinal axis A. The first actuator may be actuatable in a direction angled relative to longitudinal axis A. The tally stamp may include a second actuator. The second actuator may be actuatable in a direction perpendicular to longitudinal axis A. The first actuator may be actuatable in a direction parallel to longitudinal axis A. The tally device may include a light configured to illuminate a marking target below the marking system. The light may be activated based on motion detected by an accelerometer within the elongate body. The tally device may include a wireless transmitter configured to communicate a stored count value to a remote device after each actuation of marking system 130. The second actuator may be configured to increment the stored count by one independent of the marking system. The first actuator may be configured to reset the stored count to zero. The ink stamp may pivot between the storage position and the marking position. The front face may include a plurality of ridges and the second actuator is positioned on a ridge.

In some embodiments, a tally stamp may include an elongate body having a top and bottom, and front, rear, left and right sides extending between the top and bottom, the elongate body defining a longitudinal axis extending between the top and bottom, the front side including a plurality of ridges, an ink stamp positioned proximate the bottom of the elongate housing movable in a direction parallel to the longitudinal axis between a marking position in which the ink stamp is exposed and a storage position in which the ink stamp is retracted, and a counter system including a display, a first actuator actuatable in a direction parallel to the longitudinal axis, and a second actuator actuatable in a direction perpendicular to the longitudinal axis, the display positioned on the top of the elongate housing and having a top perimeter and a bottom perimeter, the counter system incrementing a stored count by one when the pivoting ink stamp is moved to the marking position. The display may be positioned on the top of the elongate body between the front side and rear side and the actuator is positioned on the top of the elongate body between the display and the read side.

Implementations can include any, all, or none of the following features. The second actuator may be positioned on a ridge on the front side. The tally device may include a light configured to illuminate a marking target below the marking system.

The details of one or more embodiments are set forth in the accompanying drawings and the description below. Other features and advantages will be apparent from the description and drawings, and from the claims.

DESCRIPTION OF DRAWINGS

The present description is further provided with reference to the appended Figures, wherein like structure is referred to be like numerals throughout the several views, and wherein.

DETAILED DESCRIPTION OF ILLUSTRATIVE EMBODIMENTS

Figure 1:
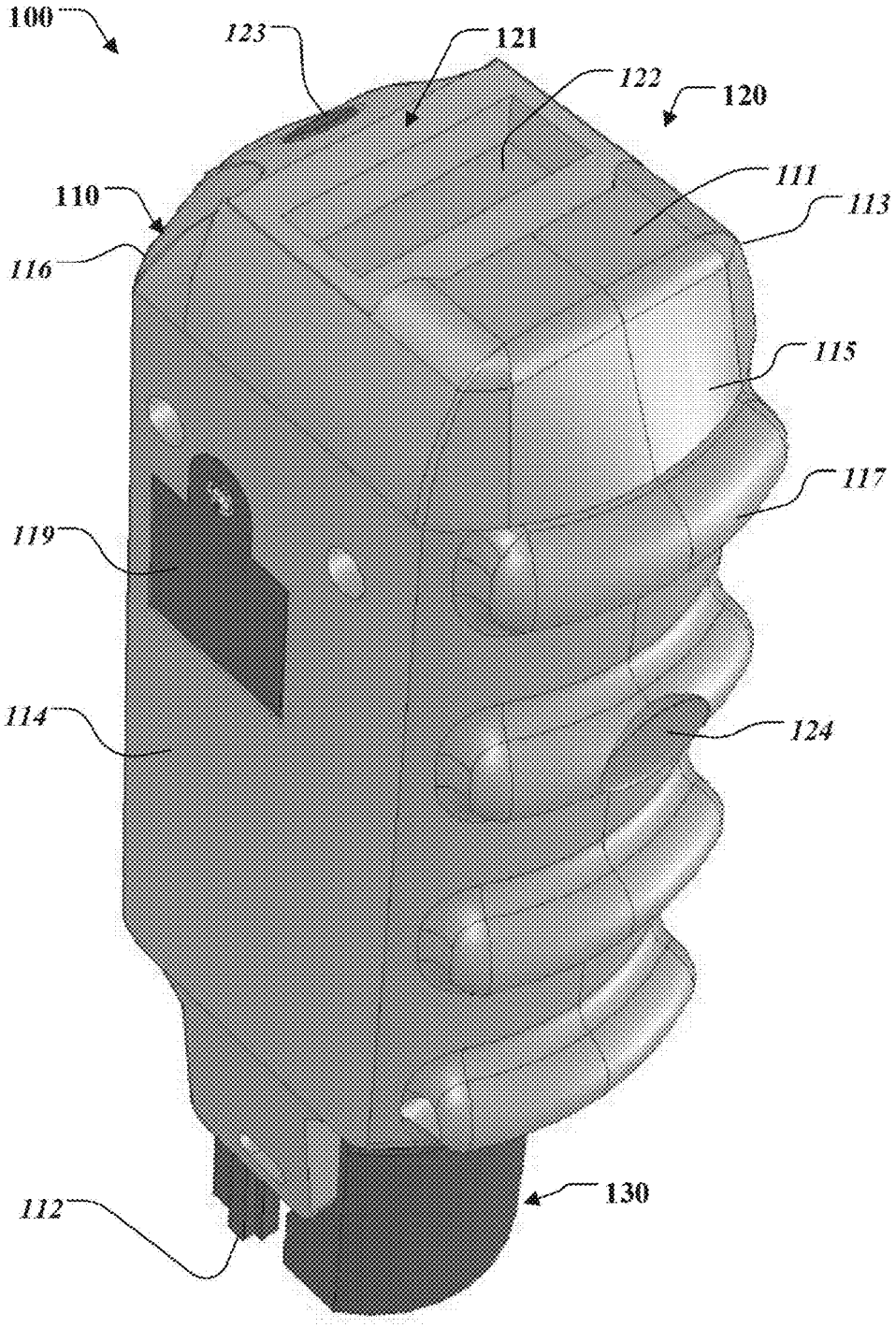
FIG. 1 is front perspective view of an exemplary tally stamp.
Figure 2:
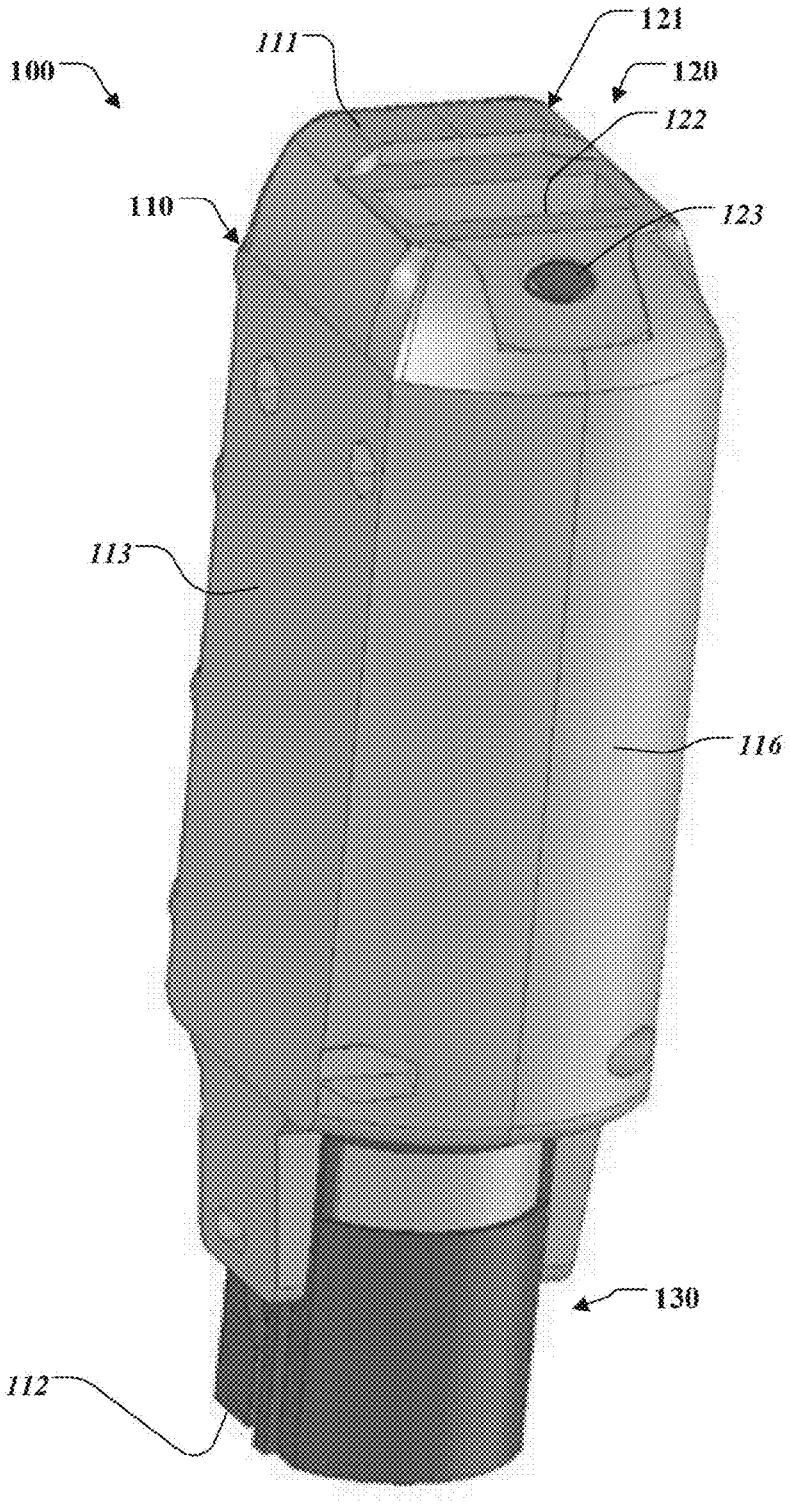
FIG. 2 is a rear perspective view of the exemplary tally stamp shown in FIG. 1.
Figures 3, 4, 5:
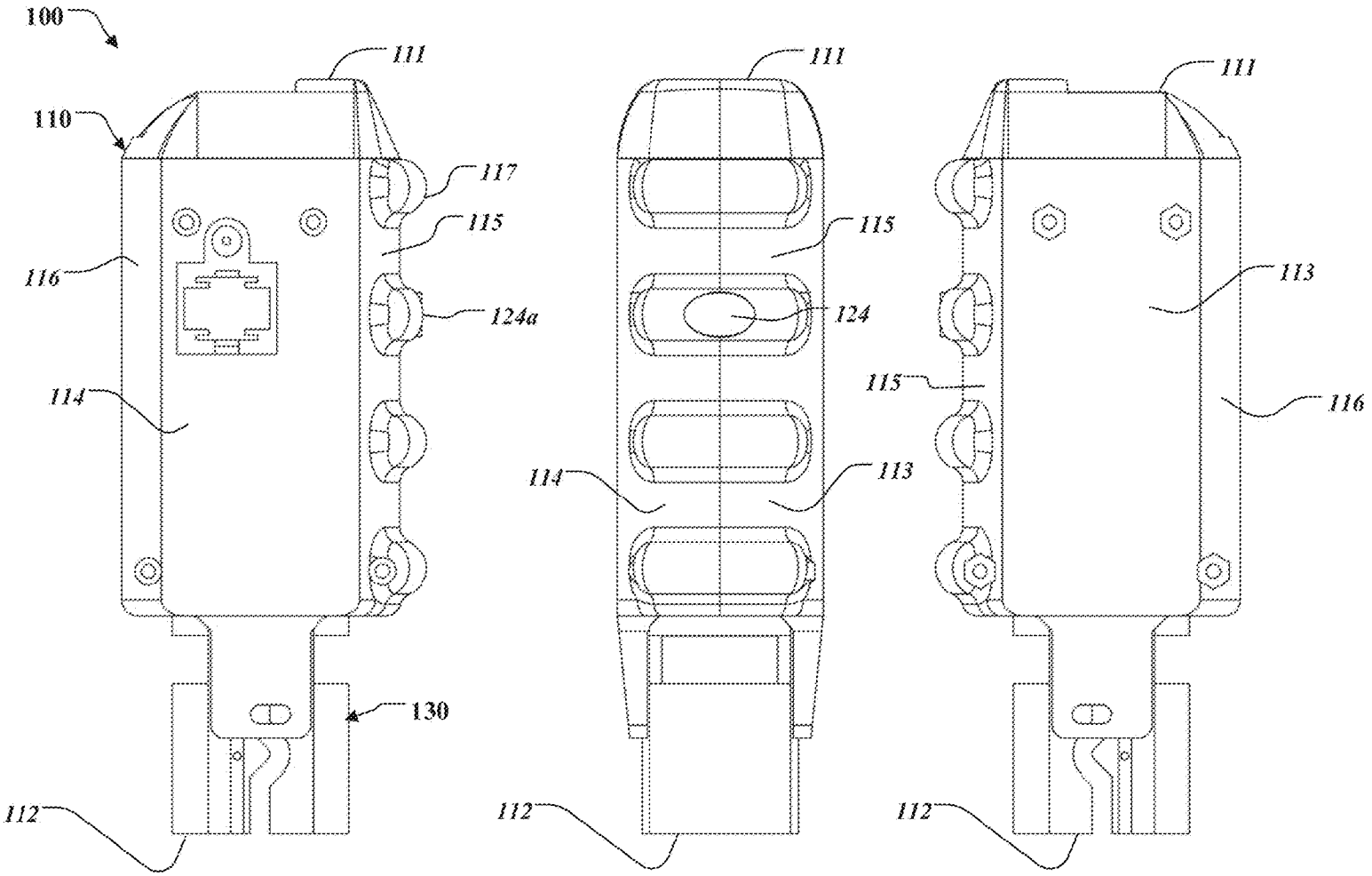
FIG. 3 is a side view of the exemplary tally stamp shown in FIG. 1.
FIG. 4 is a front view of the exemplary tally stamp shown in FIG. 1.
FIG. 5 is a side view of the exemplary tally stamp shown in FIG. 1.
Figure 6:
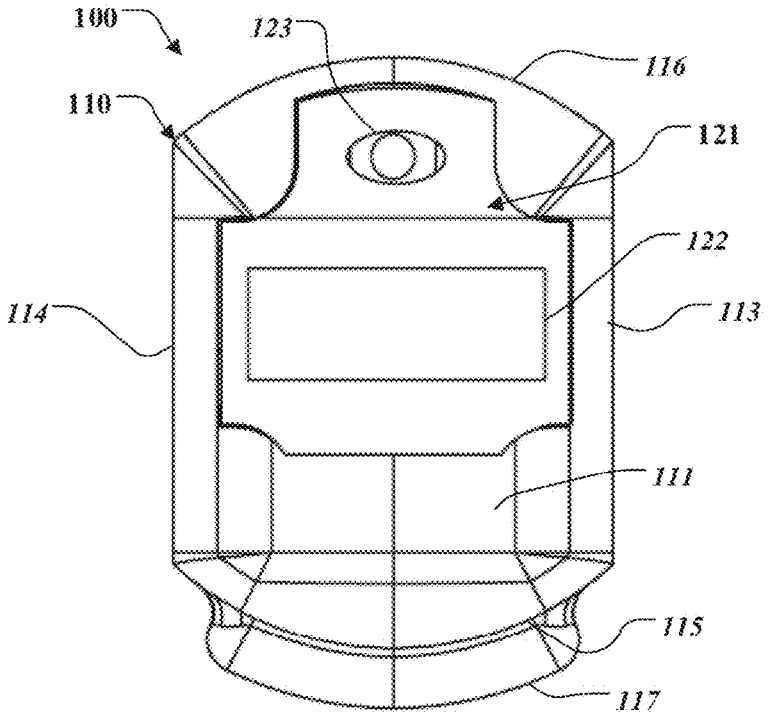
FIG. 6 is top view of the exemplary tally stamp shown in FIG. 1.
Figure 7:
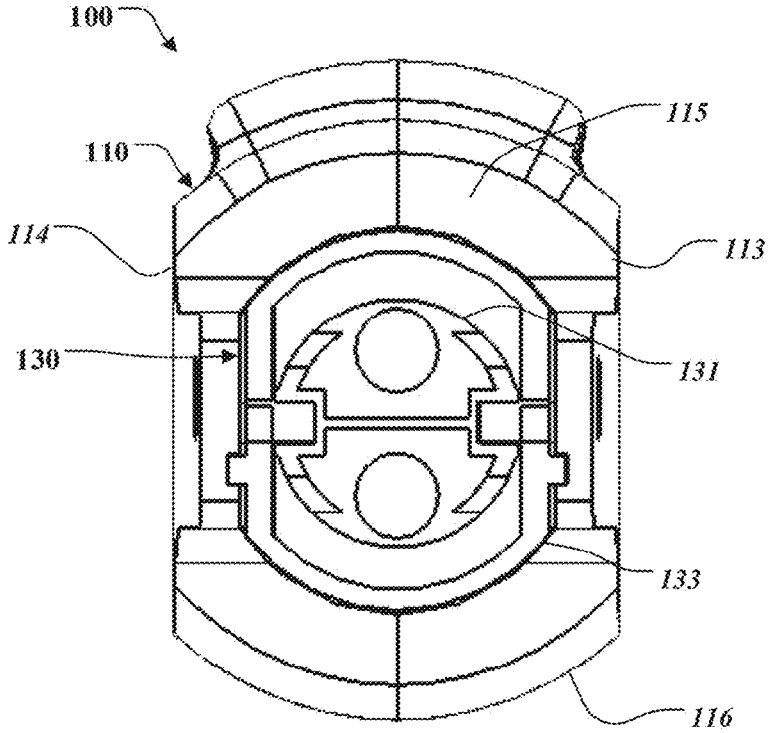
FIG. 7 is a bottom of the exemplary tally stamp shown in FIG. 1.

Referring to FIGS. 1-7, an exemplary tally stamp 100 is shown that includes an elongate body 110, a counter system 120, and a marking system 130. Elongate body 110 includes a top 111, bottom 112, and a plurality of sides extending between top 111 and bottom 112. Elongate body 110 is configured to be gripped by a user during use, in a single hand, for example, while top 111 is visible to a user and bottom 112 is at least partially exposed to allow marking of an object. A user may apply a stamp or other mark by contacting a component of marking system 130 with an object, and the counter system 120 may increment with each stamp or mark to track the number of applications. Tally stamp 100 may thus allow a user to easily apply a series of stamps or marks and track the number of stamps or marks that have been applied.

Marking system 130 is positioned proximate bottom 112 of elongate body 110 and is configured to stamp or mark an object of interest. In an exemplary embodiment, marking system 130 includes a reciprocating stamp. Marking system 130 may include a stamp pad that may be applied to an object of interest by pressing the stamp pad to the object of interest. Tally stamp 100 can be pushed onto an object to be stamped such that tally stamp 100 contacts the object, and ink, for example, is transferred from tally stamp 100 to the object. Alternatively or in addition, marking system 130 may include any type of making device that may mark an object of interest for subsequent detection, such as a felt-tip marker, pen, invisible ink applicator, or other applicator. Similarly, marking system 130 may include a marking device that applies a physical tag or marker, including an RFID tag, barcode, optical label, active transponders, passive transponders, combinations thereof, and other suitable markers.

Figure 8A:
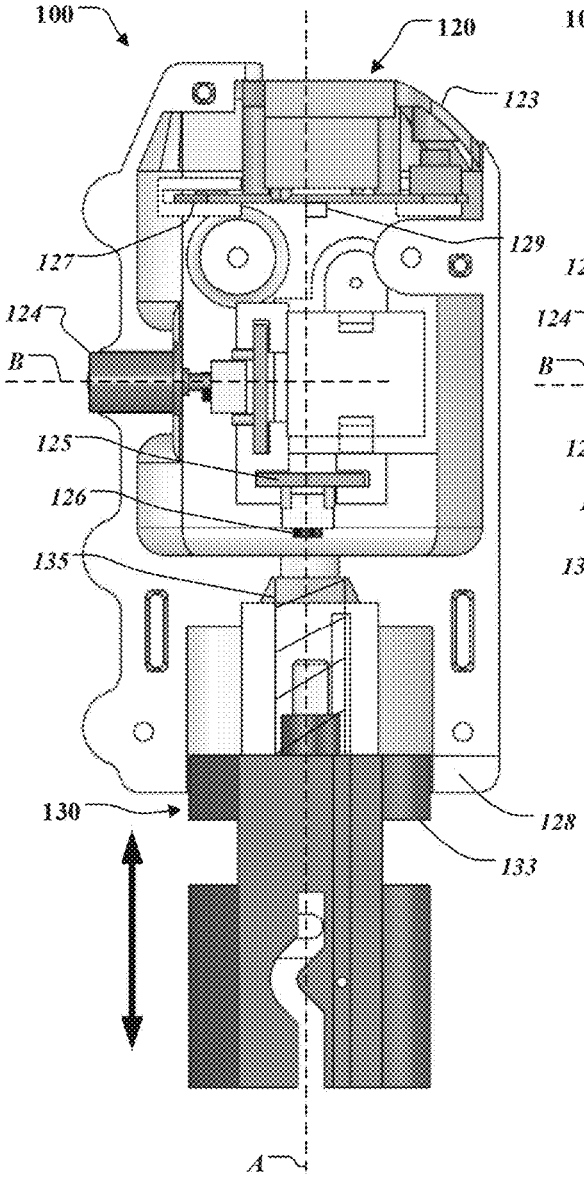
FIGS. 8A and 8B are cross-sectional views of the exemplary tally stamp shown in FIG. 1.

Tally stamp 100 includes a counter system 120 that senses the occurrence of each stamp or mark made by stamp system 130 and increments a stored count. Counter system 120 may include a user interface 121 having a display 122 and a first user input device 123, a first count actuator 126 (FIG. 8A), and a counter circuit board 125 (FIG. 8A). First count actuator 126 may be triggered by application of the stamp or mark by marking system 130. The counter circuit board 125 detects when the stamp or mark is applied based on a signal received from first count actuator 126, and counter system 120 increments a stored count value. The stored count value is displayed to a user on display 122.

Alternatively or in addition, counter system 120 may include mechanical components for storing and incrementing a count value. For example, counter system 120 may include a series of rotary dials that store a count value and are visible at display 122. Actuation of stamp system 130 may cause one or more of the rotary dials to increment the count value by one. A user may reset the stored count by manually returning the displayed values to zero (e.g. by directly manipulating the rotary dials or by a mechanism of counter system 120).

Counter system 120 may include a first user input device 123 to receive input from a user and control one or more functions of tally stamp 100. For example, first user input device 123 may serve as a void/reset button that affects the information displayed by display 122 and/or stored in counter circuit board 125. In an exemplary embodiment, first user input device 123 includes a button or switch that may be pressed by a user, and may be actuated from top 111 in a direction parallel with longitudinal axis (A). A user may press first user input device 123 to clear the stored count value and reset the display to zero.

In some exemplary embodiments, control system 100 may detect a duration or sequence of actuation of first user input device 123 so that a single actuator may be used to provide a variety of user inputs to control system 120. Counter circuit 125 may respond to a single actuation of first user input device 123 by performing a first function, and may respond to actuating and holding first user input device 123 by performing a second function. For example, first user input device 123 may include a user-actuatable button. The counter circuit may generate a signal to incrementally reduce the stored count value by one each time a user presses and quickly releases first user input device 123. The counter circuit may generate a signal to reset the stored count value to zero when a user presses and holds first user input device

123 for a predetermined duration (e.g. presses and holds first user input device 123 for 1 second, 2 seconds, 3 seconds, or other predetermined duration). Accordingly, a first user input device 123 allows a user to provide multiple inputs for tally stamp 100 to perform various functions.

Alternatively or in addition, control system 120 may include two or more user input devices to receive various inputs from a user. Control system 120 may include a second user input device 124 to perform one more functions. For example, second user input device 124 may include a user-actuatable button configured to increment the stored count by one each time the user actuates second user input device 124. In an exemplary embodiment, second user input device 124 may provide a user input to increment the stored count independent of actuation of marking system 130. Second user input device 124 may be positioned such that second user input device can be actuated by a single finger while tally device 100 is held by a user, positioned on a side of elongate body 110 and actuatable in a direction perpendicular to longitudinal axis (A), for example, along axis (B) (FIG. 8A).

Elongate body 110 of tally stamp 100 has an ergonomic shape such that tally stamp 100 may be comfortably held and operated in a single hand while shaped to house counter system 120 and marking system 130. In an exemplary embodiment, elongate body 110 includes left and right sides 113, 114 and front and rear sides 115, 116. When elongate body 110 is positioned for use in a user's hand, front side 115 may face outwardly and rear side 116 may face towards the user, and display 122 is oriented so that it may be read by the user. Front and rear sides 115, 116 may have a curved profile, for example having a convex profile, and left and right sides 113, 114 have a substantially planar profile. Alternatively or in addition, front and rear sides 115, 116 may be substantially planar, left and right sides 113, 114 may be substantially curved, or all sides may be substantially planar or curved. For example, elongate body 110 may have a substantially cylindrical shape or other curved profile so that left side 113, right side 114, front side 115, and/or rear side 116 appear to form a continuous curved surface defining the perimeter of elongate body 110.

Front side 115 may include one or more features to facilitate a secure and intuitive grip. For example, front surface may include one or more protrusions or depressions, such as ridges 117. Spaces between adjacent ridges 117 provide a natural space for fingers to be positioned in, and facilitates a secure grip by preventing elongate body 110 from sliding in a user's hand (e.g. in a direction parallel with longitudinal axis (A)) when the user stamps an object. In an exemplary embodiment, front side 115 includes four ridges 117. Left and right sides 113, 114 may have one or more ridges 117 or portions of a ridges 117. Alternatively or in addition, elongate body 110 may include a textured or rubberized surface to facilitate a secure and comfortable grip.

Elongate body 110 may be dimensioned to promote intuitive positioning of tally device 110 in a user's hand. For example, elongate body 110 has a length (l) between top 111 and bottom 112 measured parallel to a longitudinal axis (A) of tally device 100 that is greater than a width (w) of tally stamp 100 between left and right sides measured perpendicular to longitudinal axis (A) of tally device 100. In various exemplary embodiments, length (l) is between about 1.5*(w) and 8*(w), 2*(w) and 6*(w), or about 4*(w). Elongate body 110 includes a perimeter (p) around elongate body 110 at a location where the user grips elongate body 110 measured perpendicularly to longitudinal axis (A). In various exemplary embodiments, perimeter (p) may similar to length (l), and perimeter (p) may be between 0.5*(l) and 2*(l), 0.75*(l) and 1.5*(l), or about 1*(l). Such ranges have been found to allow a user to intuitively wrap their hand around elongate body 110 while display 122 remains visible from above the user's hand and marking device 130 remains accessible for marking an object below the user's hand.

Elongate body 110 may be sized and configured to facilitate use of tally device 100 with a single hand. In various exemplary embodiments, relative positioning and configuration of components of control system 120 and marking system 130 throughout elongate body 110 have been found to advantageously provide an ergonomic grip while allowing a user to readily control various functions of tally device 100. For example, sides of elongate body 110 extending between top 111 and bottom 112 provide a grip for the user to wrap their hand around. When gripped, a stamp pad, for example, of marking system 130 is accessible to apply a mark or stamp without further manipulation in the hand of the user. That is, without repositioning tally device 100 in the hand, the user can press the bottom of tally device 100 onto an object to apply a mark. Similarly, display 122 is visible when gripped in this orientation with a user's hand positioned around sides of elongate body 110.

Alternatively or in addition, one or more user inputs of user interface 121 are actuatable by the user without repositioning tally device 100. For example, first user input device 123 positioned on a top 111 of elongate body 110 is actuatable with a thumb, and/or second user input device 124 positioned on a side of elongate body 110 is actuatable with a finger. Accordingly, in some exemplary embodiments, a shape and configuration of elongate body 110 allows user actuation of marking system 130, user actuation of first and second user input devices 123, 124, and view of display 121 while a user grips the sides of elongate body 110 (e.g. without requiring repositioning of elongate body 110 in the hand after actuating marking system 130 before display 121 may be viewed or first and second user input devices 123, 124 actuated).

Elongate body 110 may be shaped to facilitate ready actuation of one or more user inputs without requiring excessive manipulation or repositioning of tally device 100 and while reducing inadvertent actuation of the user inputs. In an exemplary embodiment, second user input device 124 is positioned on a ridge 117 on front side 115 of elongate body 110, and may include a button actuatable in a direction substantially parallel to longitudinal axis (A). A user's fingers may be positioned on either side of ridge 117 when the user is not actuating second user input device 124 such that the button is not gripped by the user when holding tally device 100. A user may slide a finger over second user input device 124 and press the button. The button of second user input device 124 may thus remain sheltered by ridge 117 while being readily accessible for user actuation. In some exemplary embodiments, second user input device 124 includes an outer surface 124*a* that is substantially coplanar with an outer surface of ridge 117 such that second user input device 124 may be actuated by pressing into ridge 117. Alternatively or in addition, front side 115 includes at least one additional ridge 117 above the ridge 117 that second user input device 124 is positioned on, and/or at least one additional ridge 117 below the ridge 117 that second user input device 124 is positioned on. Such a configuration may protect second user input device 124 from inadvertent actuation by preventing actuation until a user presses the button of second user input device 124 into ridge 117 in a direction perpendicular to longitudinal axis (A), for example.

Elongate body 110 may include one or more openings to an internal cavity defined within elongate body 110. For example, elongate body 110 may define a battery receptacle to receive a battery for powering control system 120 and/or other functions of tally 100. Elongate body includes an access door 119 that facilitates access to the battery receptacle. Access door 119 may be secured by one or more threaded fasteners, snap-fit fasteners, frictional engagement, or other suitable connection, and in some embodiments may include a tight seal (e.g. provided by frictional engagement between access door 119 and other portions of elongate body 110 and/or a gasket) to prevent ingress of water.

Figure 8B:
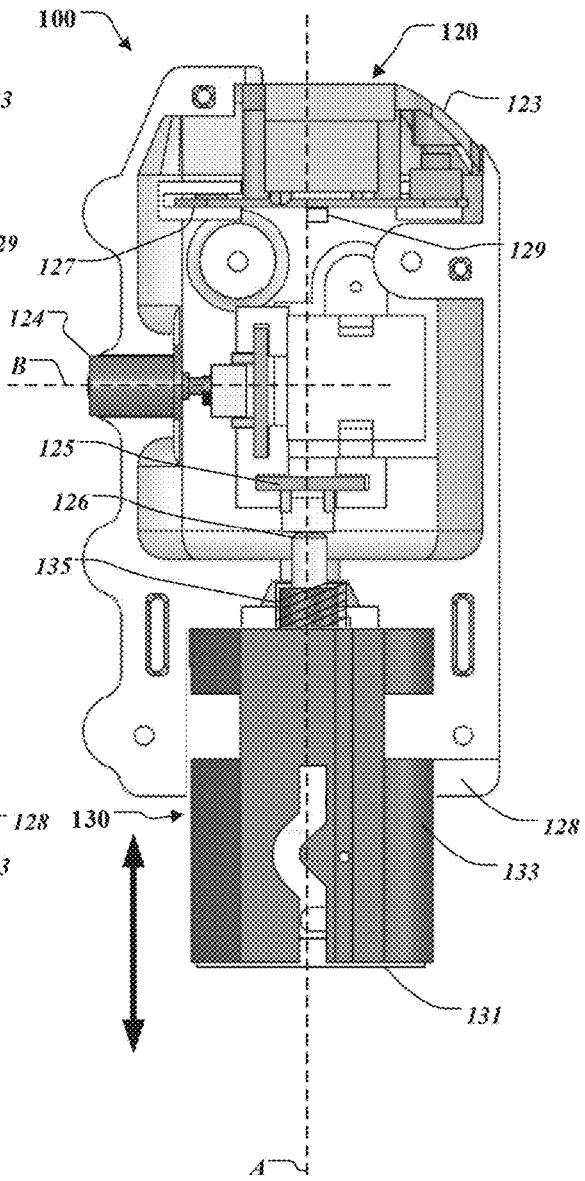

Referring to FIGS. 8A and 8B, a cross-sectional view of tally device 100 is shown, including elongate body 110, control system 120, and marking system 130. Various components of control system 120 and marking system 130 are arranged within elongate body 110 to facilitate ergonomic handling of tally device 100 and operation of various functions without requiring undue repositioning or manipulation of tally device 100 in the hand of the user.

Marking system 130 may include a self-inking reciprocating stamp having a stamp pad 131 movable between a storage configuration (FIG. 8A) and a marking configuration (FIG. 8B) in a direction parallel with a longitudinal axis (A) of elongate body 110. In the storage configuration, the stamp pad may be retracted within a component of marking system 130 and/or elongate body 110, and may be in contact with an ink pad. In the application configuration, stamp pad 131 faces outwardly for contact with an external object such that contact between stamp pad 131 and the external object results in the transfer of ink to the object.

Application of a stamping force by pressing marking system onto an object causes an outer carrier 133 of marking system 130 to travel longitudinally towards top 111 of elongate body 130 and/or stamp pad 131 to move longitudinally in a direction away from top 111 of elongate body 110. A track or guide slot 134 facilitates relative motion of stamp pad 131 and carrier 133 as marking system 130 moves to the application configuration. In the application configuration, the stamp pad is sufficiently exposed that the stamp pad can make contact to mark or stamp an object.

Stamp pad 131 may include any marker or stamp, such as an embossed rubber stamp. Stamp pad may be configured for stamping a human hand, for example, to designate authorized entry to an event, facility, or access controlled area. Alternatively or in addition, the stamp pad may be configured to mark documents, containers, other objects, animals, or other objects of interest.

Marking system 130 includes a biasing mechanism 135 that urges stamp pad 131 and/or carrier 133 towards the storage position. In operation, a user overcomes the force of biasing mechanism 135 to move stamp pad 131, for example, into the marking configuration. When the user applied force is removed, marking system 130 automatically returns to the storage configuration, due at least in part to the force of biasing mechanism 135. In an exemplary embodiment, biasing mechanism 135 is a coil spring.

Counter system 120 includes a sensor 126 configured to detect actuation of marking system 130 into the application configuration. For example, counter system 120 includes a sensor 126 including a mechanical switch oriented parallel to longitudinal axis (A) of elongate body 110. The switch is positioned such that it is activated each time the marking system 130 travels to the application configuration. Control system 120 increments a stored count by one in response to a signal related to actuation of sensor 126. In this way, each application of a stamp or mark also actuates sensor 126, and control system 120 increments a stored count by one in response. Alternatively or in addition, sensor 126 may include an optical sensor, magnetic sensor, other sensors, or combinations thereof.

The cavity of elongate body 110 may house a variety of components that may provide functionality to tally device 100. In an exemplary embodiment, tally device 100 includes a wireless transmitter 127. Wireless transmitter may communicate with one or more remote devices, such as a smartphone, tablet, computer, or other device. Wireless transmitter 127 may communicate with an application running on the smartphone, table, computer, or other device to enhance the functionality of tally device 100. The stored count may be communicated to a remote application in real time or at a user selected time. In this way, usage information related to tally stamp 100 may be communicated, directly or indirectly, to a command center in real time. In various exemplary embodiments, transmitter 127 may include Bluetooth, RF, LTE, and/or Wi-Fi components, for example. Alternatively or in addition, usage information related to tally stamp 100 may be communicated at a later time. Tally device 100 may include one or more data ports, such as a USB port, non-volatile memory card port, or other ports.

In an exemplary embodiment, an application on the device may collect and record additional information associated with each actuation of marking system 130. For example, the smartphone application may record and associate time, location, or other information related to a particular actuation of marking system 130 based on its internal clock and GPS system, respectively, for example. Such data may be collected and subsequently analyzed to garner additional information related to the usage of tally stamp 100 and the objects that are marked.

Tally stamp 100 may include one or more lights for illuminating tally stamp 100 and/or its surroundings. For example, tally device 100 may include a light 128 positioned proximate bottom 112 of elongate body 110 configured to illuminate a target stamping area. Light 128 may be activated manually by a user, for example by using a dedicated switch or other actuator, or may be activated based on use of tally device 100. In an exemplary embodiment, tally device 100 includes an accelerometer 129 within elongate body 100 and operatively connected with count system 120. Count system 120 may detect motion of tally device 100 based on a signal from accelerometer 129, and light 128 may be activated in response. For example, count system may be configured to activate light 128 upon movement of tally device 100 and deactivate light 128 after a period of limited or no movement (e.g. a period of 1 second, 5 seconds, 10 seconds, or other period). Alternatively or in addition, tally device may be responsive to a particular orientation to activate light 128. For example, when tally device is held by a user such that longitudinal axis (A) is substantially parallel to the direction of gravity (e.g. an orientation tally device 100 may be held in when a user is about to mark an object), light may be activated to illuminate the target.

Alternatively or in addition, light 128 may be configured to provide an alert to a user. For example, light 128 may be normally off and momentarily illuminate when sensor 126 detects that marking system 130 has been actuated, or more be normally on and momentarily deactivate when sensor 126 detects that marking system 130 has been actuated. Tally device 100 may include one or more additional lights, such as light 122*b* configured to illuminate display 122. Accordingly, in some exemplary embodiments, tally device includes a light 128 separate from a light 122*b* configured to illuminate display 122.

In various exemplary embodiments, various components of tally stamp 100 may be included as modules that may be assembled by a user. For example, counter system 120, marking system 130 and/or other components may be independently removable from other components of tally stamp 100. A user may thus remove and replace one or more components as desired for a particular application or when a component reaches the end of its useful life. In this way, tally stamp 100 may be readily customized by an end user by replacing marking system 130 with a stamp having a particular indicia or color, as desired for a particular application.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims.

What is claimed is:

1. A tally stamp, comprising:

an elongate body having a top and bottom, and front, rear, left and right sides extending between the top and bottom, the elongate body defining a longitudinal axis extending between the top and bottom;

an ink stamp positioned proximate the bottom of the elongate body movable in a direction parallel to the longitudinal axis between a marking position in which the ink stamp is exposed and a storage position in which the ink stamp is retracted; and a counter system comprising a first actuator and a display, the display positioned on the top of the elongate body and having a top perimeter and a bottom perimeter, the counter system incrementing a stored count by one when the pivoting ink stamp is moved to the marking position;

wherein the display is positioned on the top of the elongate body between the front side and rear side and the first actuator is positioned on the top of the elongate body between the display and the rear side; and further comprising a light configured to illuminate a marking target below the tally stamp, wherein the light is activated based on motion detected by an accelerometer within the elongate body.

2. The tally stamp of claim 1, further comprising a second actuator.

3. The tally stamp of claim 2, wherein the second actuator is actuatable in a direction perpendicular to longitudinal axis A.

4. The tally stamp of claim 3, wherein the front side comprises a plurality of ridges and the second actuator is positioned on a ridge.

5. The tally stamp of claim 3, wherein the first actuator comprises a first button and the second actuator comprises a second button, and the first and second buttons are actuatable independent of actuation of the ink stamp to the marking position.

6. The tally stamp of claim 1, further comprising a wireless transmitter configured to communicate a stored count value to a remote device after each actuation of the ink stamp to the marking position.

7. The tally stamp of claim 1, wherein the first actuator is configured to increment the stored count by one independent of actuation of the ink stamp to the marking position.

8. A tally stamp, comprising:

an elongate body having a top and bottom, and front, rear, left and right sides extending between the top side and bottom side, the elongate body defining a longitudinal axis A extending between the top side and bottom side;

an ink stamp positioned proximate the bottom side of the elongate body movable in a direction parallel to the longitudinal axis A between a marking position in which the ink stamp is exposed and a storage position in which the ink stamp is retracted; and a counter system comprising a first actuator and a display, the display positioned on the top side of the elongate body and having a top perimeter and a bottom perimeter, the counter system incrementing a stored count by one when the pivoting ink stamp is moved to the marking position, the first actuator actuatable in a direction parallel to the longitudinal axis A to affect an output of the display independent of actuation of the ink stamp to the marking position; and a second actuator;

wherein the display is positioned on the top side of the elongate body between the front side and rear side and the first actuator is positioned on the top side of the elongate body between the display and the rear side, and wherein the elongate body has a length (l) between the top and bottom sides and a width (w) between the left and right sides and length (l)>width (w); and wherein the second actuator is configured to increment the stored count by one independent of actuation of the ink stamp to the marking position.

9. The tally stamp of claim 8, wherein length (l)>2*width (w).

10. The tally stamp of claim 8, wherein the elongate body comprises a perimeter (p) measured around the front, rear, left and right sides in a direction perpendicular to longitudinal axis A, and perimeter (p) is between 0.75*(l) and 1.5*(l).

11. The tally stamp of claim 8, wherein the front side comprises a plurality of ridges.

12. The tally stamp of claim 8, wherein the first actuator is configured to reset the stored count to zero.

13. The tally stamp of claim 8, wherein the ink stamp pivots between the storage position and the marking position.

14. A tally stamp, comprising:

an elongate body having a top and bottom, and front, rear, left and right sides extending between the top side and bottom side, the elongate body defining a longitudinal axis A extending between the top side and bottom side, the front side comprising a plurality of ridges;

an ink stamp positioned proximate the bottom side of the elongate body movable in a direction parallel to the longitudinal axis between a marking position in which the ink stamp is exposed and a storage position in which the ink stamp is retracted; and a counter system comprising a display, a first actuator actuatable in a direction parallel to the longitudinal axis, and a second actuator actuatable in a direction perpendicular to the longitudinal axis, the display positioned on the top of the elongate body and having a top perimeter and a bottom perimeter, the counter system incrementing a stored count by one when the pivoting ink stamp is moved to the marking position;

wherein the display is positioned on the top side of the elongate body between the front side and rear side and the first actuator is positioned on the top of the elongate body between the display and the rear side, and wherein the first actuator comprises a first button, the second actuator comprises a second button, and the first and second actuators are configured to affect an output of the display independent of actuation of the ink stamp to the marking position.

15. The tally stamp of claim 14, wherein the second actuator is positioned on a ridge on the front side.

16. The tally stamp of claim 15, further comprising a light configured to illuminate a marking target below the tally stamp.

* * * * *